US008514041B2

(12) United States Patent
Naka et al.

(10) Patent No.: US 8,514,041 B2
(45) Date of Patent: Aug. 20, 2013

(54) MOUNTING UNIT FOR ELECTROMAGNETIC CONTACTOR AND CONNECTION STRUCTURE OF ELECTROMAGNETIC CONTACTOR USING THE SAME

(75) Inventors: Yasuhiro Naka, Kounosu (JP); Koji Okubo, Kounosu (JP); Kouetsu Takaya, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/500,004

(22) PCT Filed: Sep. 13, 2010

(86) PCT No.: PCT/JP2010/005583

§ 371 (c)(1),
(2), (4) Date: Jun. 4, 2012

(87) PCT Pub. No.: WO2011/086618

PCT Pub. Date: Jul. 21, 2011

(65) Prior Publication Data

US 2012/0268224 A1 Oct. 25, 2012

(30) Foreign Application Priority Data

Jan. 14, 2010 (JP) ..... 2010-005509

(51) Int. Cl.
*H01H 9/00* (2006.01)
*H01H 13/04* (2006.01)

(52) U.S. Cl.
USPC ..... 335/202; 335/131

(58) Field of Classification Search
USPC ..... 335/2, 132, 202, 106, 127, 131
See application file for complete search history.

(56) References Cited

U.S. PATENT DOCUMENTS

| | | | | |
|---|---|---|---|---|
| 4,345,225 | A * | 8/1982 | Lemmer | 335/132 |
| 4,717,899 | A * | 1/1988 | Drexler et al. | 335/131 |
| 5,347,250 | A * | 9/1994 | Muske | 335/132 |
| 8,324,994 | B2 * | 12/2012 | Naka et al. | 335/132 |

FOREIGN PATENT DOCUMENTS

| | | |
|---|---|---|
| JP | S62-54447 | 4/1987 |
| JP | S63-187523 | 8/1988 |
| JP | H03-266327 | 11/1991 |
| JP | H05-062577 | 3/1993 |
| JP | H08-087940 | 4/1996 |
| JP | 2009-064737 | 3/2009 |

* cited by examiner

*Primary Examiner* — Bernard Rojas
(74) *Attorney, Agent, or Firm* — Manabu Kanesaka

(57) ABSTRACT

A mounting unit for an electromagnetic contactor can prevent erroneous mounting of a non-mountable unit in a state in which a mountable unit is mounted on a case-side mounting portion, and a connection structure of an electromagnetic contactor uses the mounting unit. A mounting unit (3) for an electromagnetic contactor can be mounted on electromagnetic contactors (2*a*, 2*b*) having on a unit attaching portion (6*b*) a contactor-side mounting preventing portion (6*f*) that prevents mounting by engagement when a non-mountable unit, which cannot be mounted, is mounted. In the mounting unit (3), a unit main body (39) is provided with a mounting preventing transfer member (51) that forms a unit-side mounting preventing portion (54) that engages with a contactor-side mounting preventing portion (6*f*) when mounted on the electromagnetic contactors (2*a*, 2*b*) and prevents mounting of the non-mountable unit on a unit mounting portion (3*g*) onto which the non-mountable units (5*a*, 5*b*) are mounted.

8 Claims, 12 Drawing Sheets

5a
2a 40c
44
6e
6d 40c
43
43a
6f
6d 39
5a
40c
3g
3
2a
51a
51c 51d
52
43
43a
53
50
6e
6d
3b
54
6f

MOUNTING UNIT FOR ELECTROMAGNETIC CONTACTOR AND CONNECTION STRUCTURE OF ELECTROMAGNETIC CONTACTOR USING THE SAME

RELATED APPLICATIONS

The present application is National Phase of International Application No. PCT/JP2010/005583 filed Sep. 13, 2010, and claims priority from Japanese Application No. 2010-005509, filed Jan. 14, 2010.

TECHNICAL FIELD

The present invention relates to a mounting unit for an electromagnetic contactor that is mounted on the electromagnetic contactor when desired by the user and to a connection structure of the electromagnetic contactor using the mounting unit.

BACKGROUND ART

For example, the device described in Patent Document 1 is known as a mounting unit to be mounted on an electromagnetic contactor. This device has a pair of electromagnetic contactors having an excitation coil, a normally closed contact and a normally open contact, and also terminals thereof and are disposed in parallel to one another and an interlock block serving as a reversible unit that has connection terminals for connecting to the terminals of the aforementioned electromagnetic contactors and incorporates a wiring portion that performs interlock wiring between the connection terminals.

Patent Document 1: Japanese Patent Application No. 563-187523.

A mounting unit to be mounted on the electromagnetic contactor, in addition to the aforementioned reversible unit, is also known as an auxiliary contact unit that is provided with auxiliary circuit terminals as auxiliary terminals of the main circuit terminals of an electromagnetic contactor.

However, the electromagnetic contactor described in Patent Document 1 mentioned hereinabove is a device designed specifically for mounting only the reversible unit and is not supposed to be used for mounting other mounting units such as the auxiliary contact unit via the reversible unit.

In recent years, configurations in which the user himself stacks and mounts, as desired, a plurality of mounting units on an electromagnetic contactor have been considered. For example, a configuration has been considered in which a pair of electromagnetic contactors is arranged side by side, a reversible unit is head-on mounted between the two electromagnetic contactors, and an auxiliary contact unit is then mounted on the reversible unit.

However, since there are mountable auxiliary contact units and non-mountable auxiliary contact units depending on the configuration of the electromagnetic contactor, an erroneous mounting preventing mechanism is provided that allows the mountable auxiliary contact units to be mounted on the electromagnetic contactor and prevents the erroneous mounting of the non-mountable auxiliary contact units.

The erroneous mounting preventing mechanism is usually configured by forming a contactor-side engagement portion engaging with a unit-side engagement portion formed on the mountable unit on a unit mounting portion mounting the mounting unit of the electromagnetic contactor. The erroneous mounting preventing mechanism allows a mountable unit to be mounted on the unit mounting portion and prevents a non-mountable unit, which cannot be mounted, from being mounted on the unit mounting portion.

Where an electromagnetic contactor is provided with the above-described erroneous mounting preventing mechanism, when the mountable unit is mounted on the unit mounting portion of the electromagnetic contactor, the mounting can be performed by contacting the mounting surfaces with one another, but when the non-mountable unit is mounted on the unit mounting portion of the electromagnetic contactor, mutual contact between the mounting portions is prevented and the erroneous mounting state can be easily determined.

However, the following unresolved problem is associated with the reversible unit to be mounted between the electromagnetic contactor and the auxiliary contact unit. Thus, the reversible unit is configured to be mountable on any electromagnetic contactor, regardless of the configuration of the electromagnetic contactor, and when the auxiliary contact unit is mounted on the reversible unit, individual engagement portions mating with the case-side engagement portion of the electromagnetic contactor and the engagement portion of the auxiliary contact unit should be formed on the reversible unit, and reversible units of at least two types, namely, a reversible unit mountable on the electromagnetic contactor and a reversible unit non-mountable on the electromagnetic contactor, should be formed.

DISCLOSURE OF THE INVENTION

The present invention has been made with consideration of the above-mentioned unresolved problem associated with the abovementioned conventional example. The object of the present invention is to provide a mounting unit for an electromagnetic contactor such that if a mountable unit that can be mounted on the electromagnetic contactor and a non-mountable unit that cannot be mounted on the electromagnetic contactor are present, when the mountable unit is mounted between both units and the electromagnetic contactor, erroneous mounting of the non-mountable unit is prevented by the mountable unit of one type, and also to provide a connection structure of an electromagnetic contactor using such a mounting unit.

In order to attain the abovementioned object, one aspect of the present invention provides a mounting unit for an electromagnetic contactor that can be mounted on an electromagnetic contactor having a contactor-side mounting preventing portion on a unit mounting portion, for preventing a mounting and engaging when mounted a non-mountable unit, which cannot be mounted, wherein a unit main body comprises a mounting preventing transfer member forming a unit-side mounting preventing portion preventing the mounting of the non-mountable unit on the unit mounting portion mounting the non-mountable unit by engaging with the contactor-side mounting preventing portion when mounted on the electromagnetic contactor.

With such a configuration, in a state in which a mountable unit has been mounted on an electromagnetic contactor as desired by the user, since the unit-side mounting preventing portion has been formed at the unit mounting portion of the mountable unit by the mounting preventing transfer member, erroneous mounting of a non-mountable unit on the mountable unit can be prevented by providing only the mountable unit of one type.

In the mounting unit for an electromagnetic contactor according to another aspect of the present invention, the mounting preventing transfer member comprises a rod-shaped portion inserted into a through hole formed to pass through the unit main body in a mounting direction facing the contactor-side mounting preventing portion when mounted on the electromagnetic contactor and a fall-out preventing portion formed to protrude in an intermediate portion of the rod-shaped portion.

With such a configuration, since the mounting preventing transfer portion is movably provided at the unit main body, where the mounting preventing transfer member engages with the contactor-side mounting preventing portion formed at the unit mounting portion of the electromagnetic contactor, the unit-side mounting preventing portion identical to the contactor-side mounting preventing portion is formed at the unit mounting portion and erroneous mounting of the non-mountable unit on the unit mounting portion is prevented.

In the mounting unit for an electromagnetic contactor according to another aspect of the present invention, a connection hole is formed in at least one side portion of the unit attaching portion of the electromagnetic contactor, the contactor-side mounting preventing portion is formed close to the connection hole on the inner side thereof, a hook piece locking with the connection hole is formed to protrude in a portion for mounting on the electromagnetic contactor, the through hole is formed close to the hook piece on the inner side thereof, and a linking hole is formed outside of the through hole in the unit mounting portion.

With such a configuration, in the case in which a non-mountable unit is mounted on the unit mounting portion of the mounting unit for an electromagnetic contactor in a state after the mounting unit for electromagnetic contactors has been mounted on the unit mounting portion of the electromagnetic contactor, when the non-mountable unit is caused to move along the unit mounting portion in a state after the hook piece of the non-mountable unit has been locked to the linking hole of the unit mounting portion, the mounting preventing engagement portion formed at the unit mounting portion rapidly abuts on the non-mountable unit, a state with a tilted non-mountable unit is assumed, and the erroneous mounting state can be reliably visually identified.

In the mounting unit for an electromagnetic contactor according to another aspect of the present invention, the unit main body is mounted over a plurality of unit attaching portions of electromagnetic contactors disposed parallel to one another and incorporates an interlock mechanism prohibiting simultaneous loading of the electromagnetic contactors.

With such a configuration, since the mounting unit for an electromagnetic contactor is mounted over a plurality of unit mounting portions of electromagnetic contactors, it is possible to configure a reversible unit having an interlock mechanism that prohibits simultaneous loading of electromagnetic contactors.

The connection structure of an electromagnetic contactor according to an aspect of the present invention has at least an electromagnetic contactor, a mountable unit that can be mounted on a unit attaching portion of the electromagnetic contactor, and a non-mountable unit that cannot be mounted on the electromagnetic contactor, wherein a contactor-side mounting preventing portion preventing erroneous mounting of the non-mountable unit is formed at the unit attaching portion of the electromagnetic contactor; and the mountable unit has a mounting preventing transfer member forming a unit-side mounting preventing portion preventing a mounting of the non-mountable unit on the unit mounting portion mounting the non-mountable unit by engaging with the contactor-side mounting preventing portion.

With such a configuration, where the mounting preventing transfer member engages with the contactor-side mounting preventing portion in a state after the mountable unit has been mounted on the electromagnetic contactor, the unit-side mounting preventing portion is formed at the unit mounting portion of the mountable unit and mounting of the non-mountable unit can be prevented.

In accordance with the present invention, the mounting unit for an electromagnetic contactor is provided with the mounting preventing transfer member that engages with the contactor-side mounting preventing portion formed at the unit-side mounting portion of the electromagnetic contactor and forms the unit-side mounting preventing portion at the unit mounting portion. Therefore, by providing the mounting unit for an electromagnetic contactor of only one type, it is possible to form the unit-side mounting preventing portion corresponding to the contactor-side mounting preventing portion of the electromagnetic contactor and prevent reliably the mounting of a non-mountable unit that cannot be mounted on the electromagnetic contactor.

BRIEF DESCRIPTION OF THE DRAWINGS

FIG. 4(*b*) shows the left-side loading state; and FIG. 4(*c*) shows the right-side loading state.

FIG. 11(*b*) is a perspective view illustrating the auxiliary contact unit that cannot be mounted on the electromagnetic contactor.

BEST MODE FOR CARRYING OUT THE INVENTION

An embodiment of the present invention will be described below with reference to the appended drawings.

Figure 1:
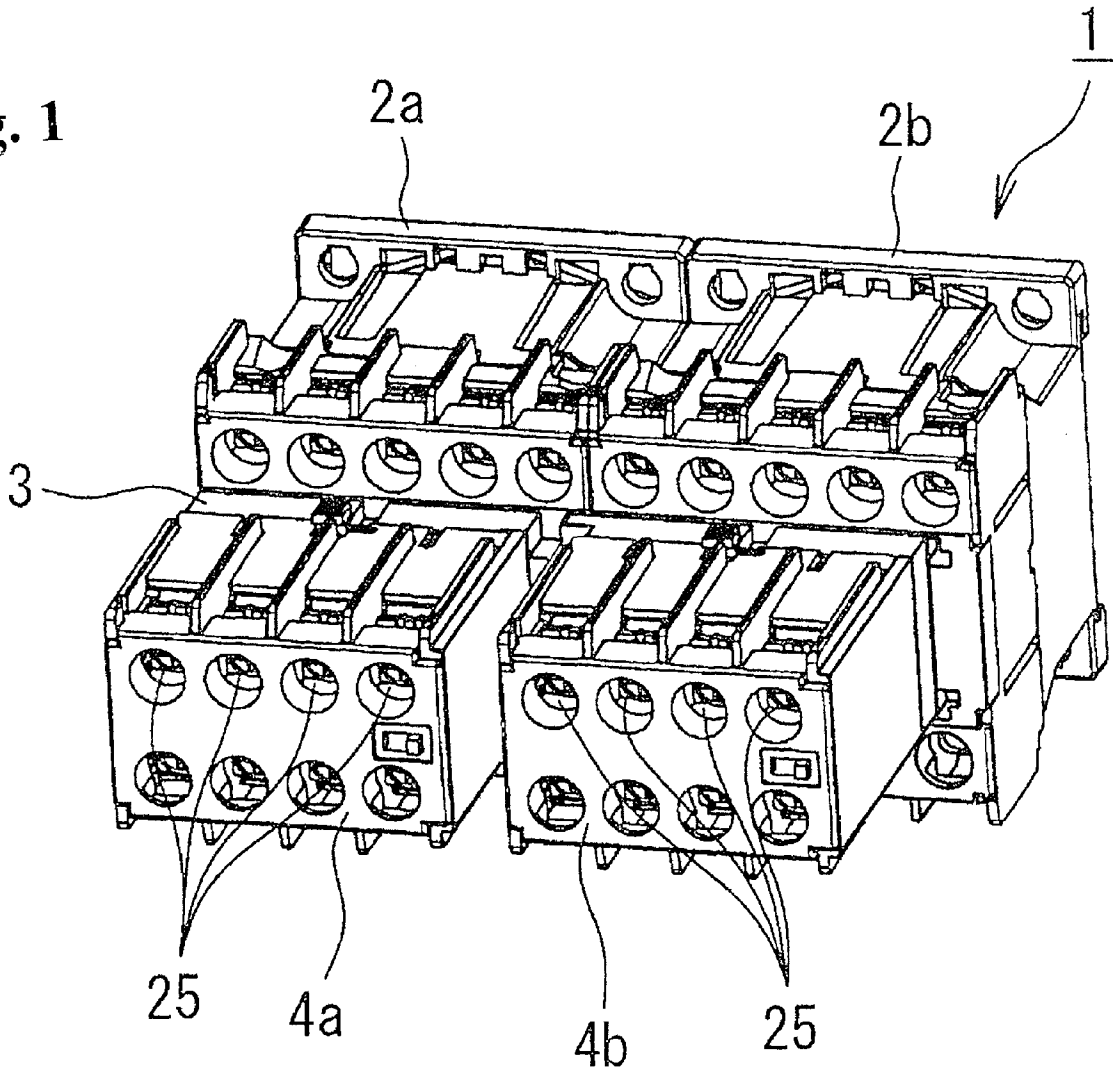
FIG. 1 is a perspective view illustrating an electromagnetic contactor device according to the present invention.

FIG. 1 is a perspective view illustrating an electromagnetic contactor device that is connected to a power feed circuit of a three-phase induction motor (not shown in the figure) and performs forward reverse control of the induction motor. An electromagnetic contactor device 1 is constituted by two electromagnetic contactors 2*a*, 2*b*, one reversible unit 3, two auxiliary contact units 4*a*, 4*b* serving as mountable units, and two auxiliary contact units 5*a*, 5*b* serving as non-mountable units.

Among the two electromagnetic contactors 2*a*, 2*b*, one electromagnetic contactor 2*a* is an electromagnetic contactor that performs forward control of the induction motor, and the other electromagnetic contactor 2*b* is an electromagnetic contactor that performs reverse control of the induction motor.

Figure 2:
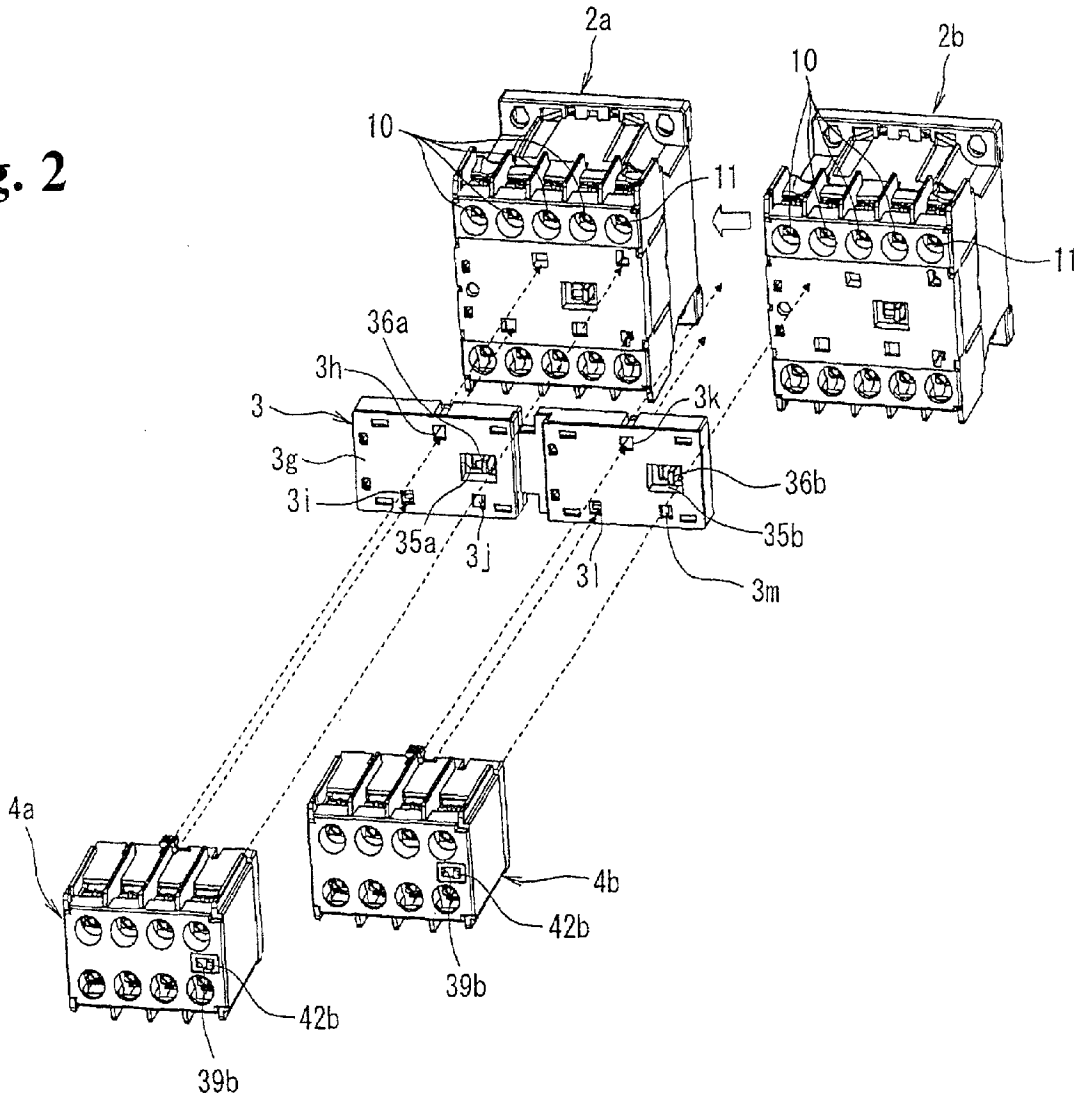
FIG. 2 is an exploded perspective view of the device shown in FIG. 1.
Figure 3:
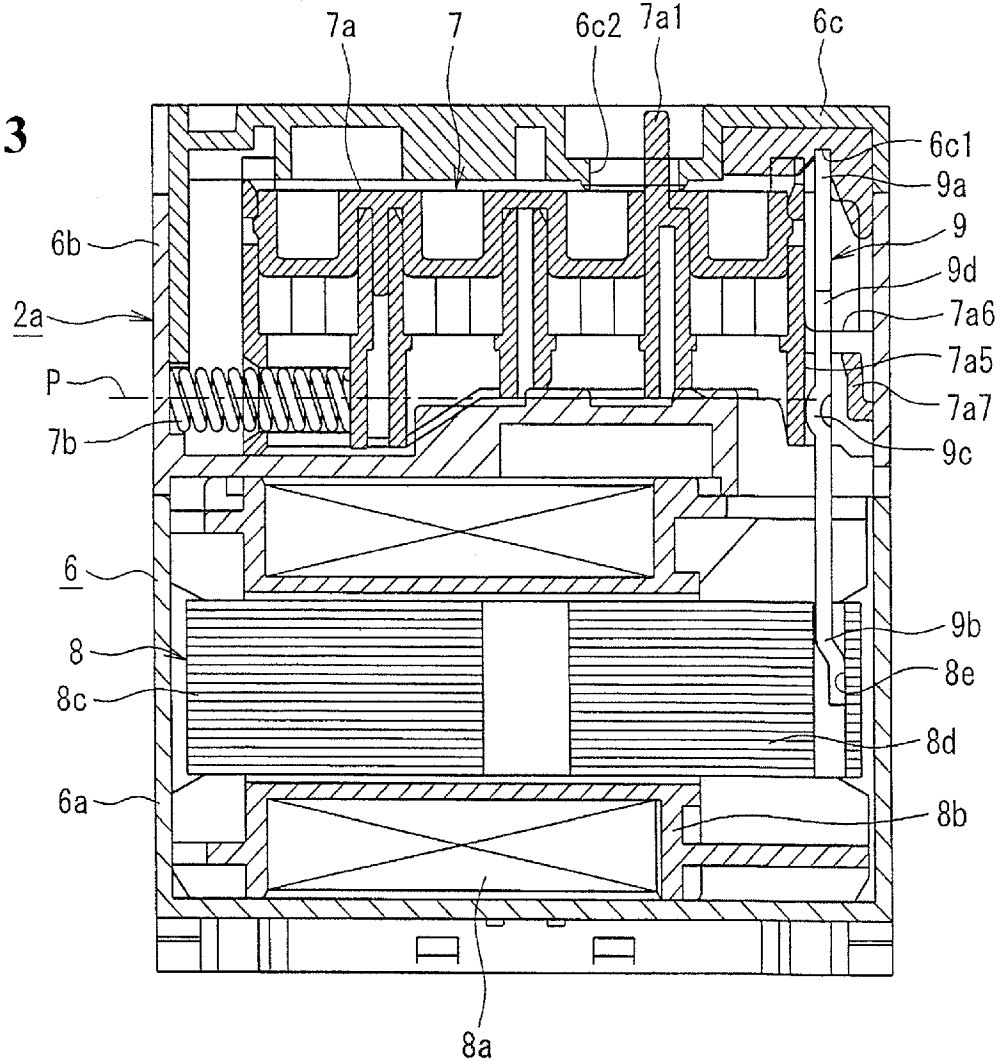
FIG. 3 is a cross-sectional view illustrating the electromagnetic contactor.

As shown in FIG. 2, the electromagnetic contactor 2*a* is a device provided with terminal portions 10 having respective contacts and a coil terminal portion 11 on the upper surface. As shown in FIG. 3, a contact portion 7, an electromagnet 8, and a drive lever 9 are accommodated in a main body case 6.

The main body case 6 has a lower case 6*a* accommodating the electromagnet 8, an upper case 6*b* accommodating the contact portion 7, and an arc-suppressing cover 6*c* that covers the upper portion of the upper case 6*b*.

Figure 6:
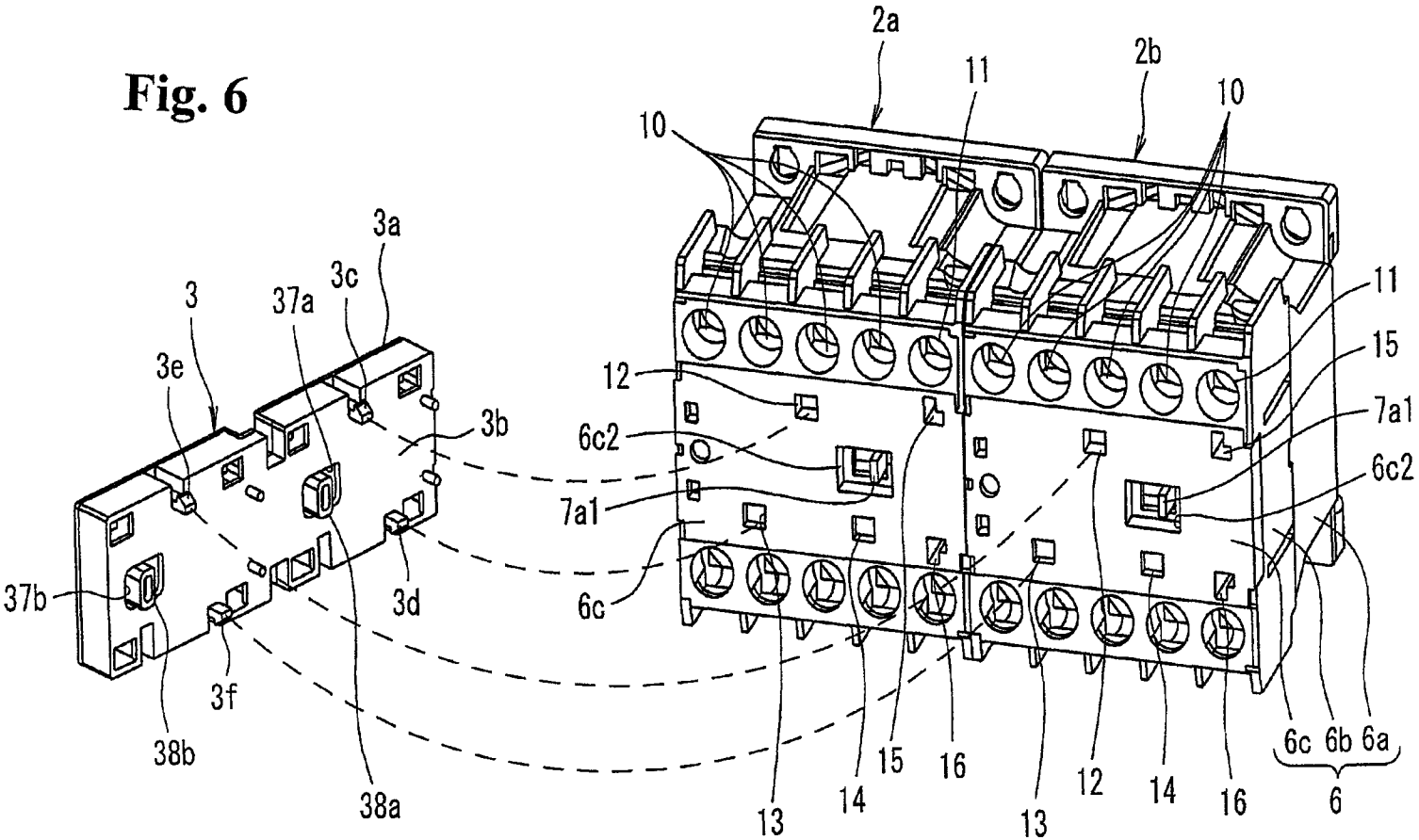
FIG. 6 is a perspective view illustrating the state before the reversible unit is mounted on a pair of electromagnetic contactors.

A rectangular display window 6*c*2 that passes through from the front surface to the rear surface is formed in the arc-suppressing cover 6*c*. An operation display piece 7*a*1 of the contact portion 7 protrudes through the display window 6*c*2 to the upper surface. Further, as shown in FIG. 6, connection holes 12 to 14 that enable connection of the one reversible unit 3 are formed in the arc-suppressing cover 6*c* to pass through from the front surface to the rear surface. The connection holes 12 to 14 have square openings.

As shown in FIG. 3, the contact portion 7 is constituted by a movable contact support 7*a* provided inside the upper case 6*b* so that the movable contact support can slide in the predetermined direction and a return spring 7*b* that pushes unidirectionally the movable contact support 7*a*.

The electromagnet 8 includes a coil frame 8*b* that has an excitation coil 8*a* mounted thereon and has an axial direction thereof set parallel to the sliding direction of the movable contact support 7*a*, a fixed core 8*c* inserted into the cavity of the coil frame 8*b* and fixed to the side wall of the lower case 6*a*, and a movable core 8*d* that is inserted into the cavity of the coil frame 8*b* and set opposite the fixed core 8*c* so as to be capable of being moved close thereto and withdrawn therefrom.

As shown in FIG. 3, the side of the movable contact support 7*a* that is opposite the side facing the return spring 7*b* is connected by the drive lever 9 to the movable core 8*d* of the electromagnet 8 in order to transmit the attraction movement and release movement of the movable core 8*d* to the movable contact support 7*a*.

The drive lever 9 is a plate-shaped member. The upper end thereof in the lengthwise direction serves as a rotation fulcrum portion 9*a*, a movable core connection portion 9*b* is formed at the other end in the lengthwise direction, a movable contact support connection portion 9*c* is provided in the central portion in the lengthwise direction, and a pair of supported portions 9*d* is formed at positions closer to the rotation fulcrum portion 9*a* than to the movable contact support connection portion 9*c*.

The movable core connection portion 9*b* of the drive lever 9 is inserted from above into a connection orifice 8*e* formed in the movable core 8*d* and connected thereto.

Further, as shown in FIG. 3, in order to transmit the attraction movement and release movement of the movable core 8*d* to the movable contact support 7*a*, the drive lever 9 connected to the movable core 8*d* and one end side of the movable contact support 7*a* withdrawn from the return spring 7*b* is accommodated in the extending condition between the lower case 6*a* and the upper case 6*b*.

The rotation fulcrum portion 9*a* of the drive lever 9 is fit into a fulcrum depression 6*c*1 provided in the lower surface of the arc-suppressing cover 6*c* and rotatably connected thereto.

The other one of electromagnetic contactors 2*b* has a structure identical to that of the one of electromagnetic contactors 2*a* and detailed explanation thereof is herein omitted.

The reversible unit 3 is an interlock device in which the two electromagnetic contactors 2*a*, 2*b* are disposed adjacently and fixed to one another and which mechanically locks the simultaneous closed-circuit (ON) state of the two electromagnetic contactors 2*a*, 2*b* even when operation signals are inputted by some operation into both electromagnetic contactors 2*a*, 2*b* (electromagnets 8 of the two electromagnetic contactors 2*a*, 2*b* are simultaneously actuated).

Figure 4:
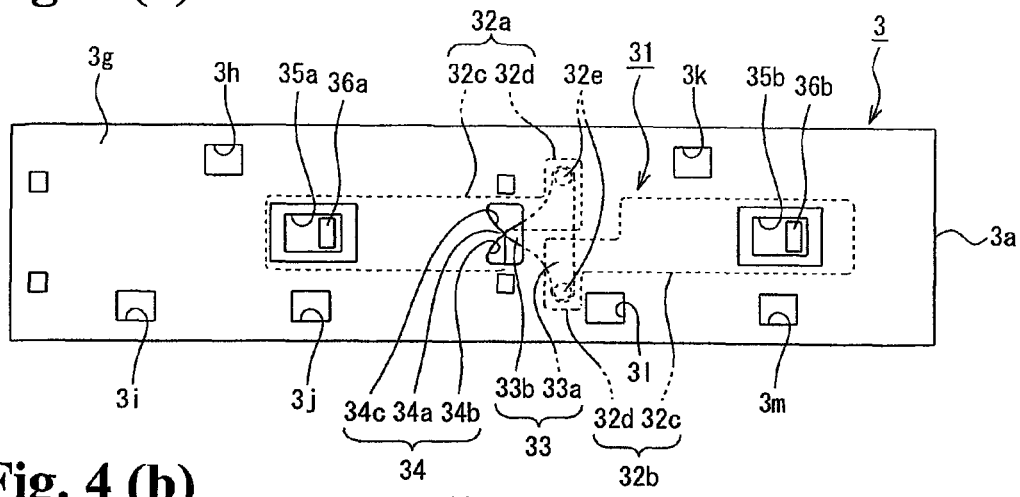
FIGS. 4(*a*) to 4(*c*) are plan views illustrating the operation of the reversible unit, wherein FIG. 4(*a*) shows the release state.
Figure 4:
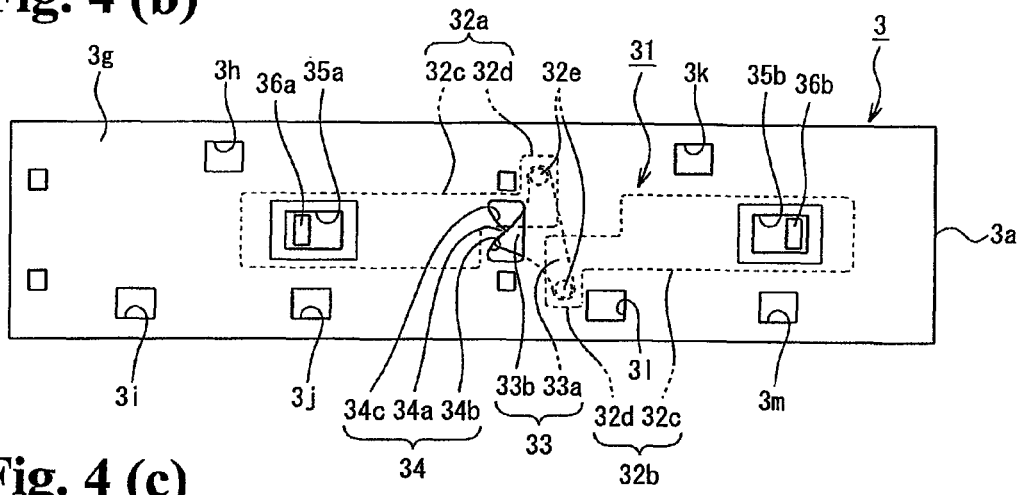
Figure 4:
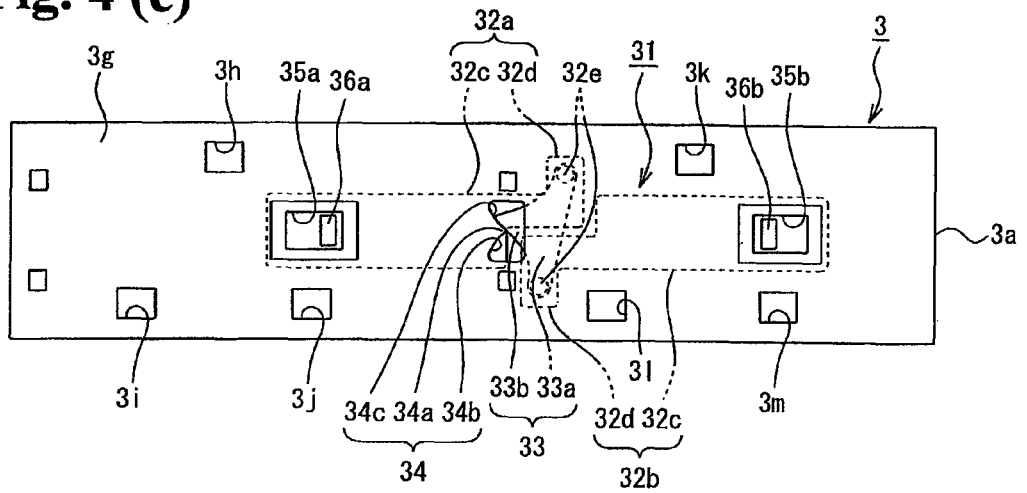
Figure 5:
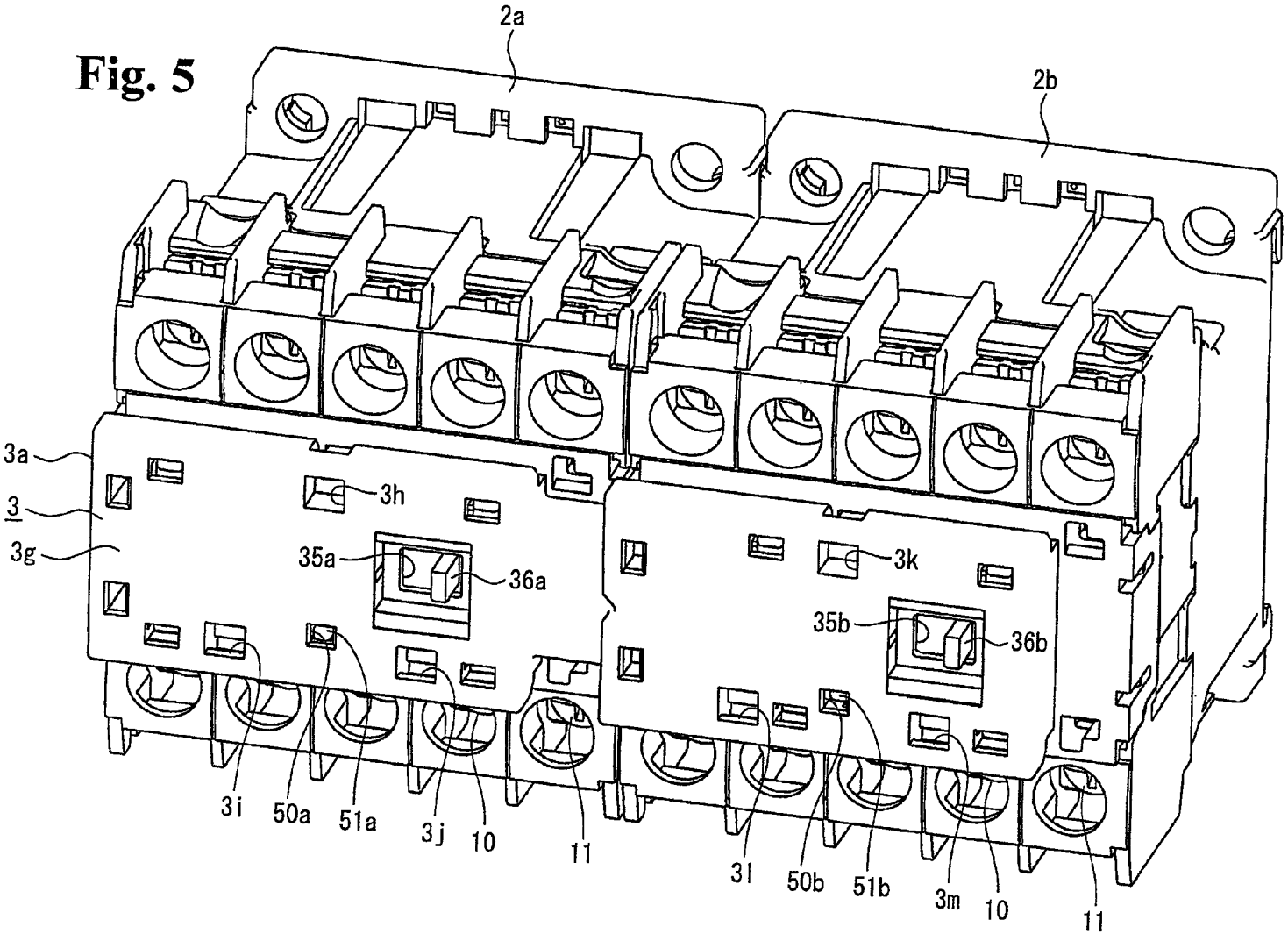
FIG. 5 is a perspective view illustrating the state in which the reversible unit is mounted on a pair of electromagnetic contactors.

As shown in FIGS. 4(*a*)-4(*c*) and 6, the reversible unit 3 has a unit main body 3*a* in the form of a rectangular parallelepiped and snap pieces 3*c* to 3*f* having hook portions with outwardly protruding distal ends that protrude from the contactor mounting portion 3*b* on the rear surface side of the unit main body 3*a* abutting on the arc-suppressing covers 6*c* of the two adjacently disposed electromagnetic contactors 2*a*, 2*b*.

Further, in the reversible unit 3, connection holes 3*h*, 3*i*, 3*j*, 3*k*, 3*l*, 3*m* that engage with a snap piece 40*a* and hook pieces 40*b*, 40*c* of the below-described auxiliary contact units 4*a*, 4*b* or 5*a*, 5*b* are formed in the unit mounting portion 3*g* for mounting the auxiliary contact units 4*a*, 4*b* or 5*a*, 5*b* on the front surface side of the unit main body 3*a*.

An interlock mechanism 31 that mechanically locks the simultaneous closed-circuit (ON) state of the two electromagnetic contactors 2*a*, 2*b* is provided inside the unit main body 3*a*. As shown in FIG. 4, the interlock mechanism 31 is constituted by sliding members 32*a*, 32*b* that are individually connected to the operation display piece 7*a*1 of the electromagnetic contactors 2*a*, 2*b* and can slide in the coupling direction, that is, lengthwise direction, of the electromagnetic contactors 2*a*, 2*b*, a sliding restricting member 33 that connects the opposing portions of the these sliding members 32*a*, 32*b* at one surface side, from among the front and rear surface sides, and restricts the sliding of one of the sliding members 32*a*, 32*b* relative to the sliding of the other, and a rotation restricting member 34 that faces the sliding restricting member 33 and restricts the rotation thereof.

The sliding members 32*a*, 32*b* are formed to have the same, point symmetrical shape, in the plan view thereof, and constituted by a rectangular plate portion 32*c* and a hook-like portion 32*d* formed on the outside at the inner end of the rectangular plate portion 32*c* and bent outward in the direction perpendicular to the lengthwise direction. The sliding members 32*a* and 32*b* are disposed so that the hook-like portions 32*d* are opposite each other in a back-to-back state, as shown in FIG. 4(*a*), in the released state (lock release state).

The sliding restricting member 33 is constituted by a base portion 33*a* engaged with an engagement pin 32*e* formed at the outward end side of the hook-like portion 32*d* of the sliding members 32*a* and 32*b* and a triangular protruding portion 33*b* protruding from the center of the base portion 33*a* toward the sliding member 32*a* side.

The rotation restricting member 34 has at least an apex portion 34*a* that adjacently faces the apex portion of the triangular protruding portion 33*b* of the sliding restricting member 33 in the released state, a rotation restricting wall portion 34*b* that is circular-arc surface following the movement trajectory of the apex portion of the triangular protruding portion 33*b* generated when the sliding member 32*a* is caused to slide from the released state through the apex portion 34*a*, and a rotation restricting wall portion 34*c* that is circular-arc surface following the movement trajectory of the apex portion of the triangular protruding portion 33*b* generated when the sliding member 32*b* is caused to slide from the released state through the apex portion 34*b*.

In the sliding members 32*a* and 32*b*, operation display pieces 36*a* and 36*b* that protrude from rectangular unit windows 35*a* and 35*b* formed in the surface of the unit main body 3*a* are formed at the front surface side, as shown in FIG. 4, and tubular display piece engagement portions 38*a* and 38*b* that protrude from the rectangular unit windows 37*a* and 37*b* formed in the rear surface of the unit main body 3*a* are formed at the rear surface side, as shown in FIG. 6.

With the aforementioned electromagnetic contactors 2*a*, 2*b* being in the open-circuit (OFF) state, the reversible unit 3 is mounted on the electromagnetic contactors 2*a* and 2*b*. In this case, as shown in FIG. 6, the distal end of the snap piece 3*c* of the reversible unit 3 is inserted into the connection hole 12 of the electromagnetic contactor 2*a* and engaged with the circumferential edge of the opening, and the distal end of the snap piece 3*d* is inserted into the connection hole 13 of the electromagnetic contactor 2*a* and engaged with the circumferential edge of the opening, while the display piece engagement portions 38*a* and 38*b* of the reversible unit 3 are being engaged with the respective operation display pieces 7*a*1 of the electromagnetic contactors 2*a*, 2*b*. Then, the distal end of the snap piece 3*e* of the reversible unit 3 is inserted into the connection hole 12 of the electromagnetic contactor 2*b* and engaged with the circumferential edge of the opening, and the distal end of the snap piece 3*f* is inserted into the connection hole 13 of the electromagnetic contactor 2*b* and engaged with the circumferential edge of the opening. As a result, the reversible unit 3 is mounted on the electromagnetic contactors 2*a* and 2*b*.

In the mounted state of the reversible unit 3, the electromagnetic contactors 2*a* and 2*b* are both in the open-circuit (OFF) state. Therefore, as shown in FIG. 4(*a*), in the interlock mechanism 31, the sliding members 32*a* and 32*b* are both at the right positions and assume the released state, and the base portion 33*a* of the sliding restricting member 33 is oriented substantially perpendicular to the lengthwise direction. Therefore, the apex portion of the triangular protruding portion 33*b* in the sliding restricting member 33 of the interlock mechanism 31 adjacently faces the apex portion 34*a* of the rotation restricting member 34, and the sliding restricting member 33 can rotate about one end of the base portion 33*a* as a center.

Where the electromagnetic contactor 2*a* is set to the closed-circuit (ON) state from the released state of the interlock mechanism 31, the movable core 8*d* of the electromagnetic contactor 2*a* is attracted and moved to the fixed core 8*c*. Following this movement, the movable contact support 7*a* of the contact portion 7 moves via the drive lever 9 against the force of the return spring 7*b* and assumes the inserted state.

Where the electromagnetic contactor 2*a* thus assumes the inserted state, the operation display piece 7*a*1 of the contact portion 7 of the electromagnetic contactor 2*a* moves from the open-circuit (OFF) position shown in FIG. 4(*a*) to the closed-circuit position shown in FIG. 4(*b*). Since the sliding member 32*a* of the reversible unit 3 is connected to the operation display piece 7*a*1, the sliding member 32*a* moves from the open-circuit (ON) position shown in FIG. 4(*a*) to the closed-circuit position and assumes a left-side inserted state as shown in FIG. 4(*b*). Therefore, the sliding restricting member 33 rotates counterclockwise about the engagement pin 32*e* of the sliding member 32*b* as a center, and the triangular protruding portion 33*b* contacts with or adjacently faces the rotation restricting wall portion 34*b* of the rotation restricting member 34.

In the left-side inserted state, the triangular protruding portion 33*b* of the sliding restricting member 33 contacts with or adjacently faces the rotation restricting wall portion 34*b* of the rotation restricting member 34. Therefore, when the right electromagnetic contactor 2*b* is to be set in the closed-circuit (OFF) state, the sliding member 32*b* of the interlock mechanism 31 is to be moved via the display piece 7*a*1 of the electromagnetic contactor 2*b* from the open-circuit (OFF) position shown in FIG. 4(*b*) to the closed-circuit (ON) position on the sliding member 32*b* side. As a result, the sliding restricting member 33 will be rotated clockwise about the engagement pin 32*e* of the sliding restricting member 32*a* as a center, but because the triangular protruding portion 33*b* contacts with the rotation restricting wall portion 34*b* of the rotation restricting member 34, the sliding restricting member 33 is prevented from rotating. As a result, when the left electromagnetic contactor 2*a* is in the closed-circuit (ON) state, the right electromagnetic contactor 2*b* is reliably prevented from switching to the closed-circuit (ON) state.

Likewise, where the right electromagnetic contactor 2*b* is set to the closed-circuit (ON) state, as shown in FIG. 4(*c*), when the interlock mechanism 31 of the reversible unit 3 is in the released state, as shown in FIG. 4(*a*), the sliding member 32*b* of the interlock mechanism 31 moves to the sliding member 32*a* side via the operation display piece 7*a*1 of the electromagnetic contactor 2*b*. Following this movement, the sliding restricting member 33 rotates clockwise about the engagement pin 32*e* of the sliding member 32*a* as a center and the triangular protruding portion 33*a* contacts with or adjacently faces the rotation restricting wall portion 34*c* of the rotation restricting member 34. Therefore, by restricting the counterclockwise rotation of the sliding restricting member 33, it is possible to prevent the sliding member 32*a* from sliding in the direction of withdrawal from the sliding member 32*b*. Therefore, the left electromagnetic contactor 2*a* is reliably prevented from switching from the open-circuit (OFF) state to the closed-circuit (ON) state.

The auxiliary contact units 4*a*, 4*b* as mountable units and the auxiliary contact units 5*a*, 5*b* as non-mountable units are all the devices having auxiliary circuit terminals 25, as shown in FIG. 1.

Figure 11:
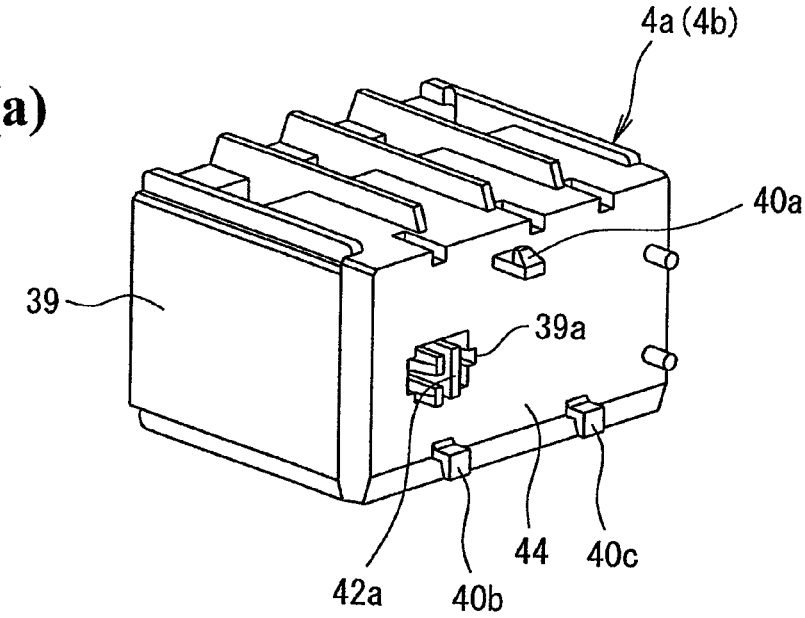
FIGS. 11(*a*) and 11(*b*) show the auxiliary contact unit, wherein FIG. 11(*a*) is a perspective view illustrating the auxiliary contact unit that can be mounted on the electromagnetic contactor.
Figure 11:
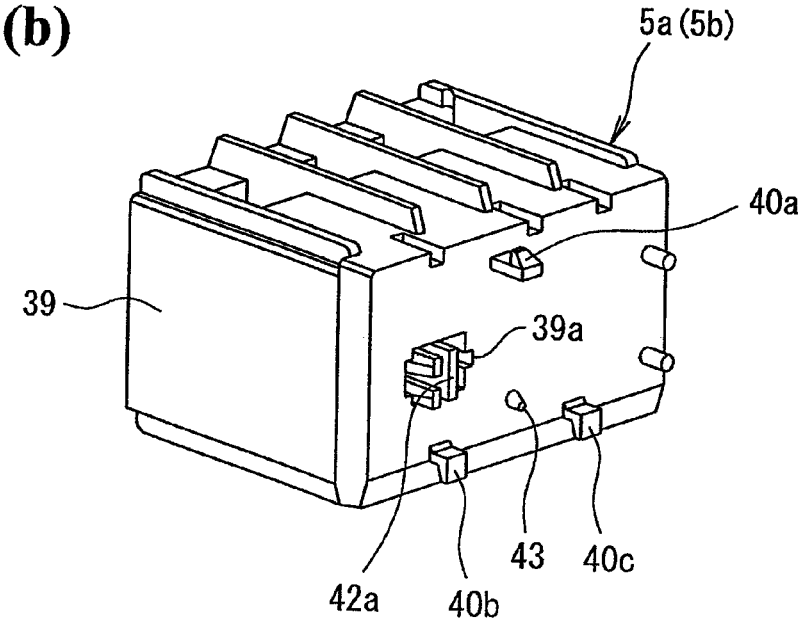

As shown in FIG. 11(*a*), the auxiliary contact unit 4*a* has a contact portion (not shown in the figure) inside the main body case 39 and is also provided with the snap piece 40*a* that protrudes downward from one side of the bottom surface of the main body case 39 and has a locking hook that protrudes outward and locks with the connection hole 12 of the electromagnetic contactors 2*a*, 2*b* and the connection hole 3*h* or connection hole 3*k* of the reversible unit 3 and hook pieces 40*b*, 40*c* with an inversed L-shaped cross section that protrude in the same direction from the other side of the bottom surface of the main body case 39 and have outward protruding lower ends that are locked to the connection holes 13, 14 of the electromagnetic contactors 2*a*, 2*b* and also connection holes 3*i*, 3*j* or connection holes 3*l*, 3*m* of the reversible unit 3.

Further, a display piece engagement portion 42*a* that can engage and move integrally with the operation display pieces 7*a*1 of the electromagnetic contactors 2*a* and 2*b* or the reversible unit operation display pieces 36*a*, 36*b* of the reversible unit 3 is formed at the lower surface of the main body case 39 so as to protrude from the unit window 39*a* formed in the lower surface of the main body case 39. The display piece engagement portion 42*a* is connected to the movable contact support (not shown in the figure) similar to the movable contact support 7*a* in the contact portion 7 of the above-described electromagnetic contactors 2*a*, 2*b* and provided inside the main body case 39. The display piece engagement portion 42*a* is also connected to an auxiliary contact unit operation display piece 42*b* protruding from the unit window 39*b* formed in the upper surface of the main body case 39.

Inside the main body case 39, there are also provided a return spring (not shown in the figure) creating a spring urging force that urges the movable contact support to one side similarly to the contact portion 7 of the above-described electromagnetic contactors 2*a*, 2*b*, a plurality of movable contacts (not shown in the figure), each supported by a contact spring (creating a spring bias force in the direction opposite that of the spring bias force created by the return spring) to enable movement in the same direction as the movable contact support, and a plurality of fixed contacts (not shown in the figure) supported on the main body case 39 so as to face the plurality of movable contacts in the movement direction.

As shown in Table 1 below, the auxiliary contact units include auxiliary contact units 4*a*, 4*b* serving as mountable units that can be mounted on the electromagnetic contactors 2*a*, 2*b* and auxiliary contact units 5*a*, 5*b* as non-mountable units. Thus, when the electromagnetic contactors 2*a*, 2*b* have contact configurations of two systems, namely, A and B, and the auxiliary contact units are also of two systems, namely, of a two-contact type [I] and a four-contact type [II], the auxiliary contact units 4*a*, 4*b* of the two-contact type [I] can be mounted on both the A-type electromagnetic contactor and the B-type electromagnetic contactor, whereas the auxiliary contact units 5*a*, 5*b* of the four-contact type [II] can be mounted on the A-type electromagnetic contactor, but cannot be mounted on the B-type electromagnetic contactor.

TABLE 1

| | | Auxiliary contact unit | |
|---|---|---|---|
| | | [I] | [II] |
| Electromagnetic contactor | [A] | ○ | ○ |
| | [B] | ○ | x |

Figure 7:
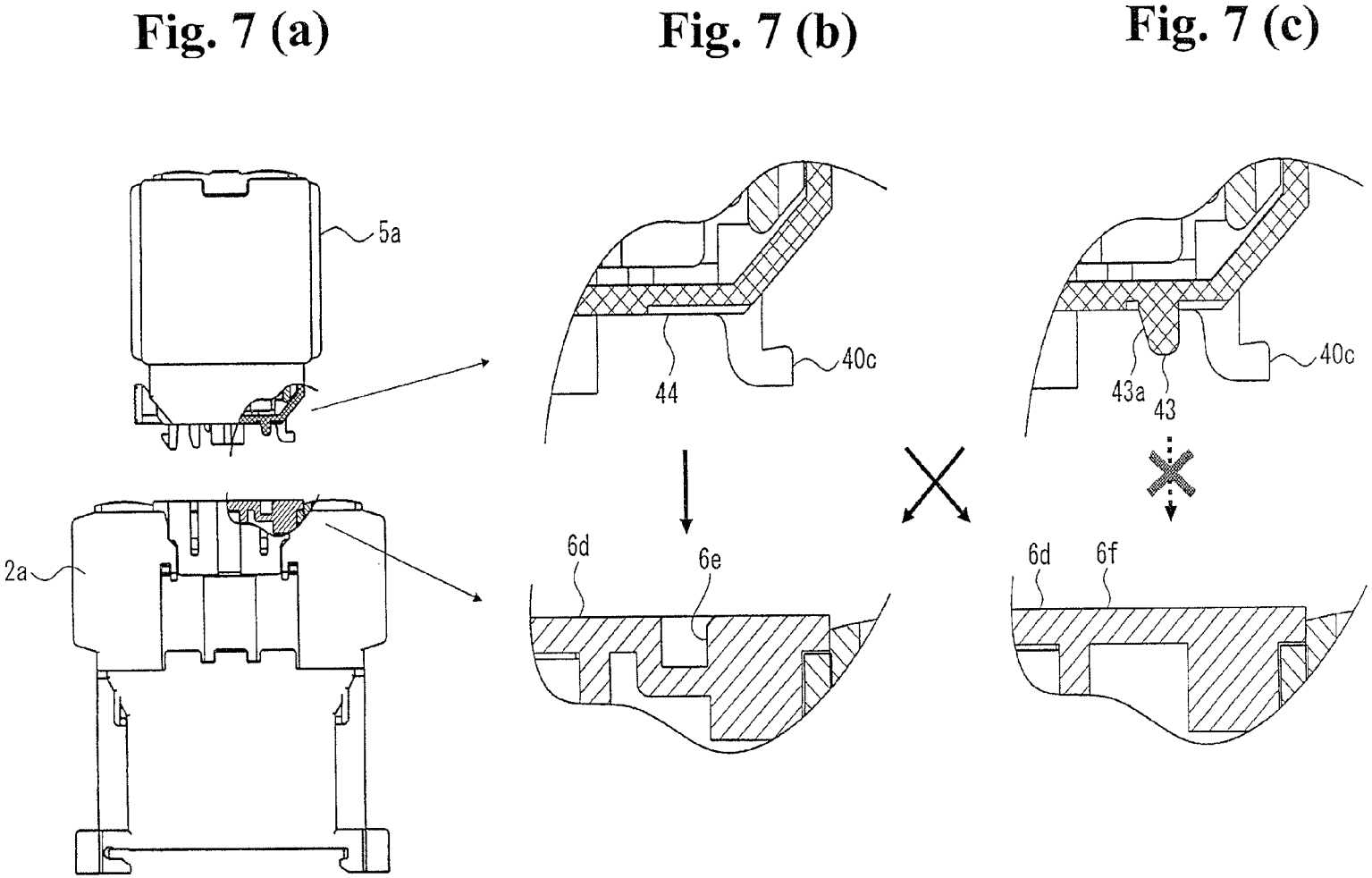
FIGS. 7(*a*) to 7(*c*) are diagrams showing a mounting relationship of the electromagnetic contactor and auxiliary contact unit.

Therefore, in order to prevent erroneous mounting of the auxiliary contact units 5*a*, 5*b* that cannot be mounted on the electromagnetic contactor, a unit-side mounting preventing portion 43 is provided on the lower surface side of the main body case 19 of the auxiliary contact units 5*a*, 5*b* of the four-contact type [II] for which mountable electromagnetic contactors and non-mountable electromagnetic contactors are present. The unit-side mounting preventing portion 43 is an engaging protrusion that protrudes downward at a position between the hook portions 40*b* and 40*c* and at a position that is close to the line connecting the hook portions 40*b* and 40*c* on the inner side thereof, as shown in FIG. 7(*c*) and FIG. 11(*b*). The unit-side mounting preventing portion 43 has a tilted surface 43*a* on the side opposite that facing the hook portions 40*b* and 40*c*, this tilted surface being tapered from the bottom surface of the main body case 39 toward the distal end.

By contrast, in the auxiliary contact unit of the two-contact type [I], which can be mounted regardless of the electromagnetic contactor type, the flat surface 44 is provided that has no unit-side mounting preventing portion 43 formed thereon, as shown in FIG. 7(*b*) and FIG. 11(*a*).

In the A-type electromagnetic contactors 2*a*, 2*b* on which all of the auxiliary contact units can be mounted, as shown in FIG. 7(*b*), a contactor-side mounting allowing portion 6*e* that is an engagement depression for engagement with the unit-side mounting preventing portion 43 is formed at a position opposite the unit-side mounting preventing portion 43 in the unit attaching portion 6*d* on the upper surface of the arc-suppressing cover 6*c*.

By contrast, in the B-type electromagnetic contactors 2*a*, 2*b* on which the auxiliary contact units 5*a*, 5*b* of the four-contact type [II] cannot be mounted, as shown in FIG. 7(*c*), a contactor-side mounting preventing portion 6*f*, which is a flat surface preventing the erroneous mounting, is formed at a position opposite the unit-side mounting preventing portion 43*a* in the unit attaching portion 6*d* of the upper surface of the arc-suppressing cover 6*c*.

Thus, in order to prevent erroneous mounting, the electromagnetic contactors 2*a*, 2*b* and the auxiliary contact units 5*a*, 5*b* are provided with the contactor-side mounting allowing portion 6*e*, contactor-side mounting preventing portion 6*f*, and unit-side mounting preventing portion 43, and these portions constitute an erroneous mounting preventing mechanism. In the auxiliary contact units 4*a*, 4*b*, the unit-side mounting preventing portion 43 is omitted and the flat surface 44 is formed.

Figure 8:
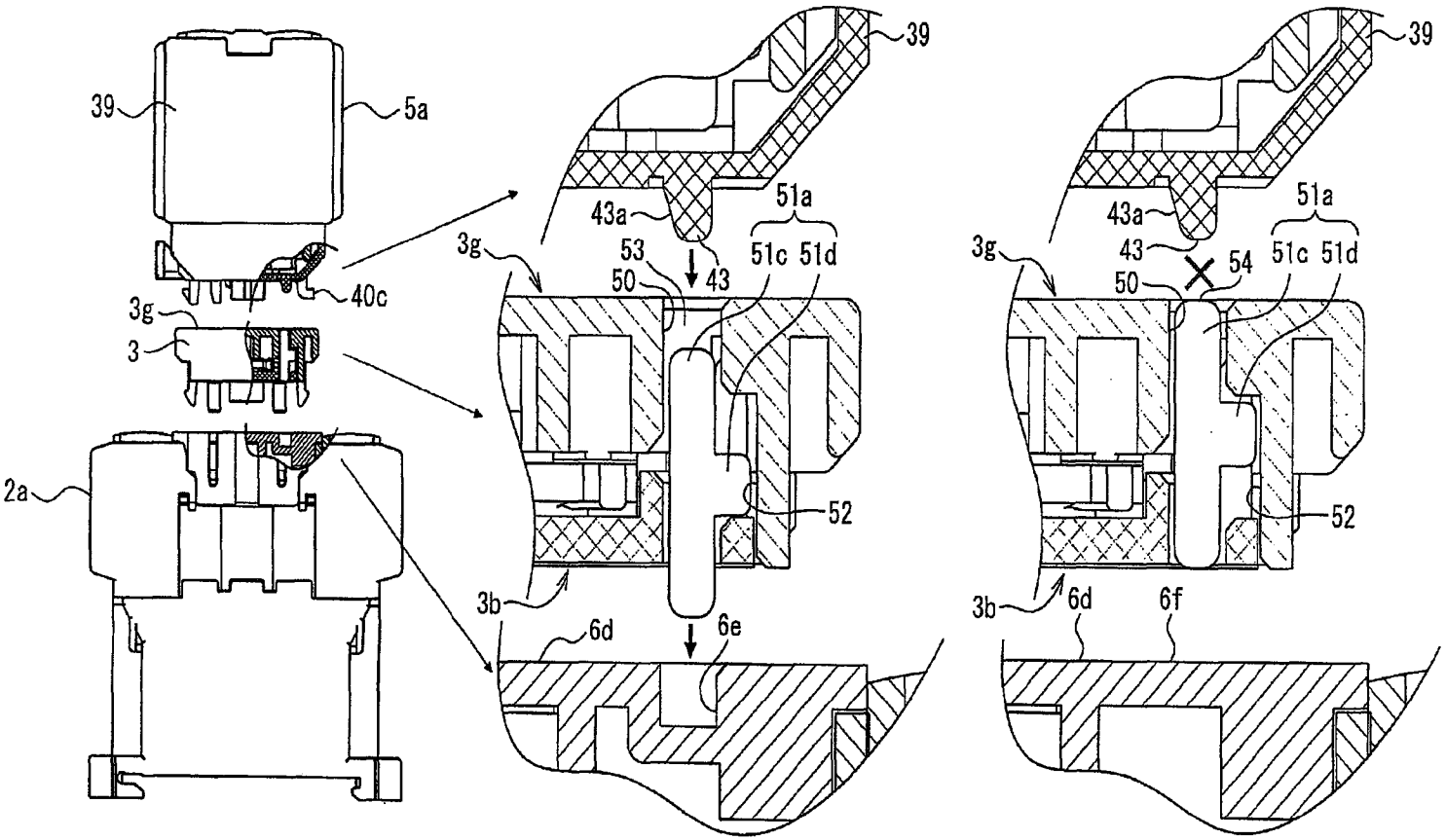
FIGS. 8(*a*) to 8(*c*) are diagrams illustrating the state in which the auxiliary contact unit is mounted on the electromagnetic contactor, with the reversible unit being interposed therebetween.
Figure 9:
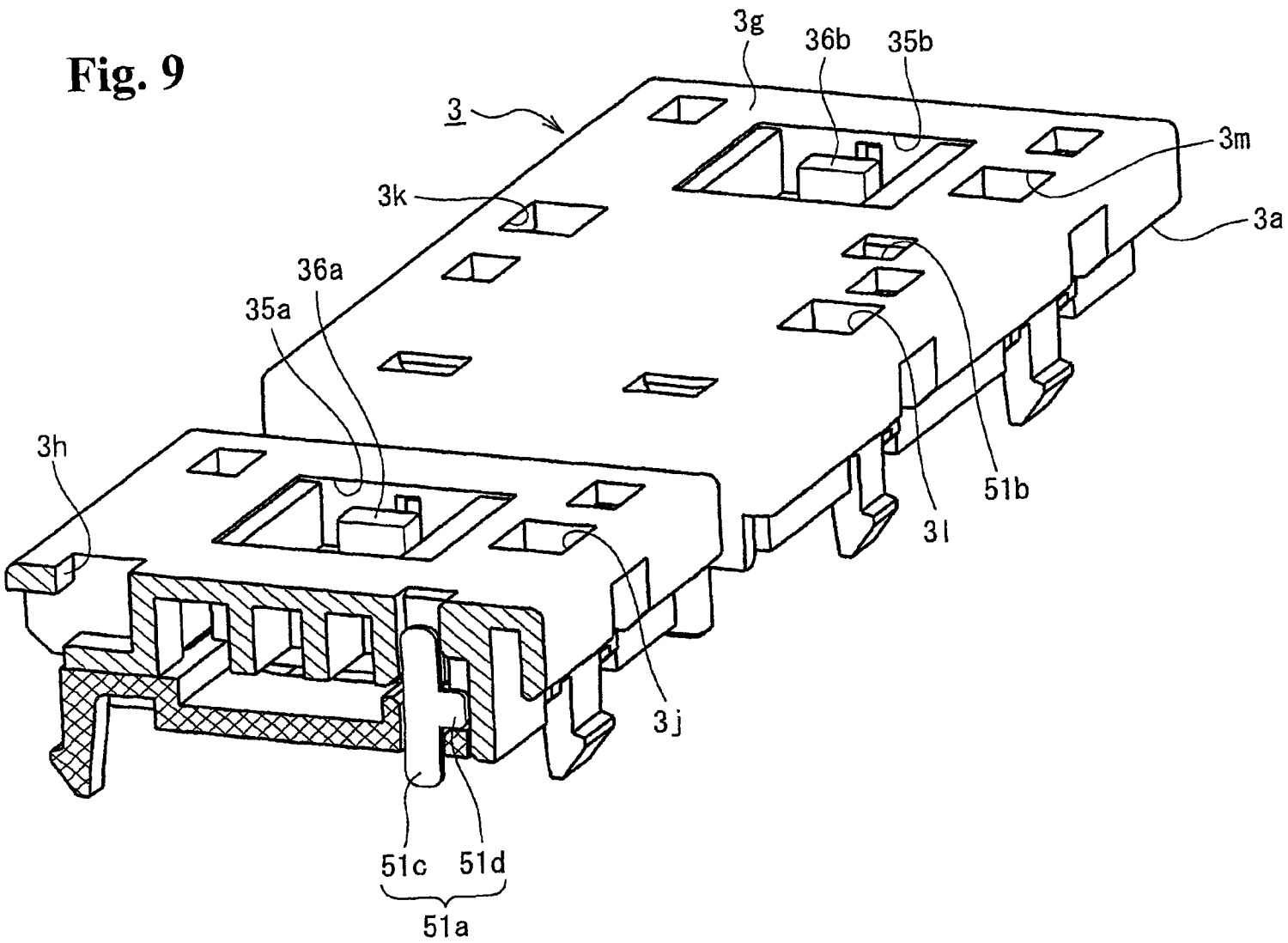
FIG. 9 is a perspective view illustrating the position of the mounting preventing transfer member by a cross section.
Figure 10:
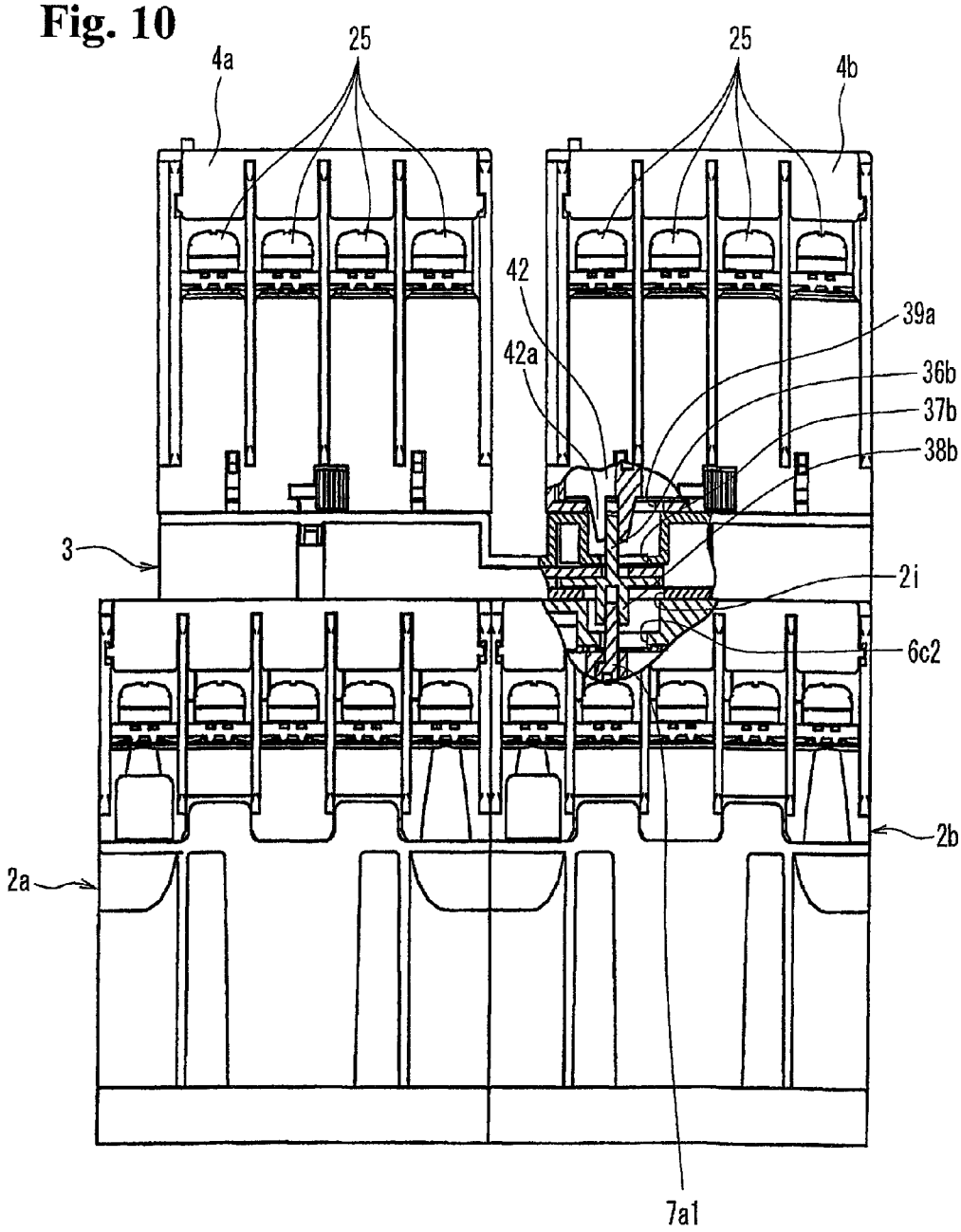
FIG. 10 is a side view illustrating a portion of configuration in the state after the reversible unit and auxiliary contact unit have been mounted on the electromagnetic contactor by a cross section.

By contrast, in the reversible unit 3, as shown in FIGS. 8(*a*)-8(*c*) and FIG. 9, through holes 50*a*, 50*b* with a square cross section that pass from the front surface to the rear surface are formed at positions opposite the engagement depression 6*e* formed in the arc-suppressing cover 6*c* of the electromagnetic contactors 2*a*, 2*b*. In a state in which the reversible unit 3 is mounted on the electromagnetic contactors 2*a*, 2*b*, mounting preventing transfer members 51*a*, 51*b* that transfer the contactor-side mounting allowing portion 6*e* or the contactor-side mounting preventing portion 6*f*, which is formed in the arc-suppressing cover 6*c* of the electromagnetic contactors 2*a*, 2*b*, to the unit mounting portion 23*g* on the upper surface side are slidably inserted into the aforementioned through holes 50*a*, 50*b*. Each of these mounting preventing transfer members 51*a*, 51*b* is constituted by a rod-shaped portion 51*c*, for example formed in a quadrangular columnar shape, that is inserted in the through holes 50*a*, 50*b* and a fall-out preventing portion 51*d* that is formed to protrude outward in the intermediate portion of the rod-shaped portion 51*c*. The fall-out preventing portion 51*d* communicates with the through holes 50*a*, 50*b* inside the case main body 3*a* and is engaged with a guiding groove 52 that is closed at the front and rear surface sides. The length of the rod-shaped portion 51*c* is set to be substantially equal to the distance between the front and rear surfaces of the reversible unit 3.

The operation of the above-described embodiment will be described below.

In order to mount a pair of electromagnetic contactors 2*a*, 2*b* on the reversible unit 3, first, the electromagnetic contactors 2*a*, 2*b* contact with one another by the side walls thereof in a state in which the two electromagnetic contactors are oriented in the same direction. In this state, the electromagnets 8 of the electromagnetic contactors 2*a*, 2*b* are in a non-conductive state, and the movable contact support 7*a* of the contact portion 7 is pushed by the return spring 7*b* and maintained in the open-circuit (OFF) state. Therefore, the operation display piece 7*a*1 of the electromagnetic contactors 2*a*, 2*b* is in the open-circuit position on the right side, as shown in FIG. 6.

In this state in which the reversible unit 3 is set such that the operation display pieces 36*a* and 36*b* are at the open-circuit position at the right side, the snap pieces 3*c*, 3*d* and 3*e*, 3*f* of the reversible unit 3 are located opposite the connection holes 12, 13 formed in the arc-suppressing cover 6*c* of the electromagnetic contactor 2*a* and the connection holes 12, 13 formed in the arc-suppressing cover 6*c* of the electromagnetic contactor 2*b*, respectively. Where the reversible unit 3 is pushed down toward the electromagnetic contactors 2*a*, 2*b* side in this state, the snap pieces 3*c*, 3*d* and 3*e*, 3*f* are inserted and locked in the connection holes 12, 13 of the electromagnetic contactors 2*a*, 2*b*, and the display piece engagement portions 38*a* and 38*b* of the reversible unit 3 are engaged with the operation display pieces 7*a*1 of the electromagnetic contactors 2*a* and 2*b*.

In the case in which the electromagnetic contactors 2*a* and 2*b* are of the A type that enables mounting, regardless of the type of the auxiliary contact units 4*a*, 4*b*, the contactor-side mounting allowing portion 6*e*, which is constituted by an engagement depression, is formed at the intermediate position, in the longitudinal direction, of the two connection holes 13, 14 close to and on the inner side of the line connecting the connection holes 13, 14 in the arc-suppressing cover 6*c* of the electromagnetic contactors.

Therefore, when the reversible unit 3 is mounted on the electromagnetic contactors 2*a*, 2*b*, as shown in FIG. 8(*b*), the mounting preventing transfer members 51*a* and 51*b* of the reversible unit 3 face the contactor-side mounting allowing portions 6*e* of the electromagnetic contactors 2*a* and 2*b*, respectively, and these mounting preventing transfer members 51*a* and 51*b* are engaged or can be engaged with the contactor-side mounting allowing portions 6*e*.

Where mounting of the reversible unit 3 on the electromagnetic contactors 2*a*, 2*b* is thus completed, the auxiliary contact units 4*a*, 4*b* or 5*a*, 5*b* are mounted on the unit mounting portion 3*g* of the reversible unit 3.

In this case, as shown in FIG. 7(*b*), the unit-side mounting preventing portion 43 is not formed at the position opposite the contactor-side mounting preventing portion 6*e* of the electromagnetic contactors 2*a*, 2*b* on the lower surface of the auxiliary contact units 4*a*, 4*b* that can be mounted on both A type and B type of the electromagnetic contactors 2*a*, 2*b*, and this lower surface is the flat surface 44.

Figure 12:
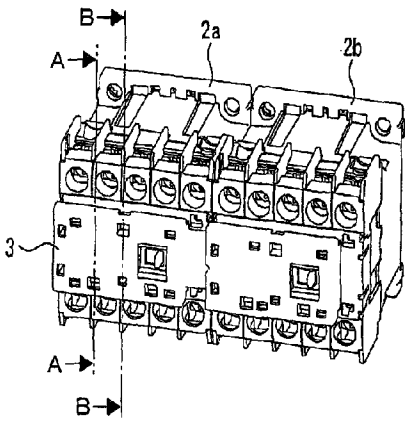
FIGS. 12(*a*) to 12(*c*) illustrate the state in which the non-mountable auxiliary contact unit is mounted on the reversible unit.
Figure 12:
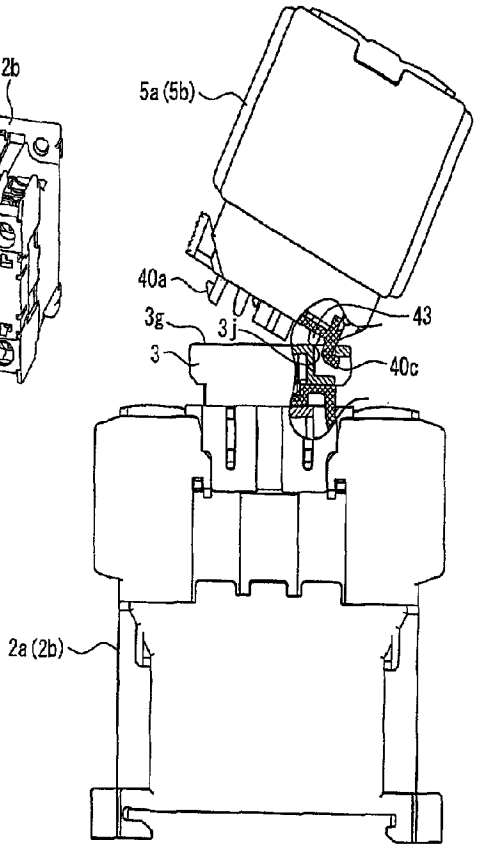
Figure 12:
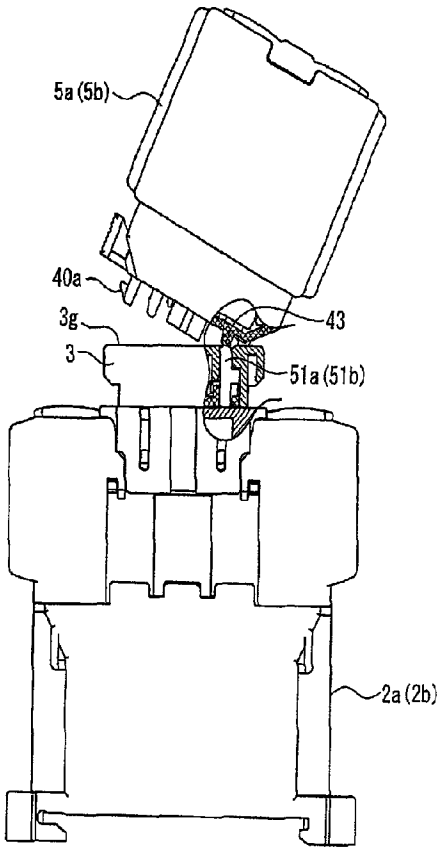

Therefore, for example, in order to mount the auxiliary contact unit 4*a* on the reversible unit 3, the auxiliary contact unit 4*a* is tilted as shown in FIG. 12(*b*), and the hook pieces 40*b*, 40*c* formed at the rear surface side are inserted and locked in the connection holes 3*i*, 3*j* formed in the unit mounting portion 3*g* of the reversible unit 3. Then, the lower surface of the auxiliary contact unit 4*a* is rotated to contact with the unit mounting portion 3*g* of the reversible unit 3, and the snap piece 40*a* is inserted and locked in the connection hole 3*h* formed in the unit mounting portion 3*g* of the reversible unit 3. In this case, since the unit-side mounting preventing portion 43 is not formed at the rear surface of the auxiliary contact unit 4*a* and this rear surface is the flat surface 44, the rear surface of the auxiliary contact unit 4*a* intimately contacts with and mounted on the unit mounting portion 3*g* of the reversible unit 3.

The auxiliary contact unit 4*b* can be also mounted on the reversible unit 3 in a similar manner.

By contrast, in the auxiliary contact units 5*a*, 5*b* where the non-mountable electromagnetic contactors 2*a*, 2*b* are present, the unit-side mounting preventing portion 43 constituted by an engagement protrusion is formed, as shown in FIGS. 8(*a*)-8(*c*) and FIGS. 11(*a*)-11(*b*), close to and on the inner side of a line connecting the hook portions 40*b*, 40*c* and at a position between the hook pieces 40*b*, 40*c*. Therefore, when the auxiliary contact units 5*a*, 5*b* are attempted to be mounted on the unit mounting portion 3*g* of the reversible unit 3 in the same manner as described above, the unit mounting preventing portion 43 engages with the mounting preventing transfer members 51*a*, 51*b*. In this case, the contactor side mounting allowing portion 6*e* is formed at the electromagnetic contactors 2*a*, 2*b* and the mounting preventing transfer members 51*a*, 51*b* are opposite the contactor-side mounting allowing portion 6*e*.

When the mounting preventing transfer members 51*a*, 51*b* engage inside the contactor-side mounting allowing portion 6*e*, as shown in FIG. 8(*b*), the unit-side mounting allowing portion 53 similar to the contactor-side mounting allowing portion 6*e* of the electromagnetic contactors 2*a*, 2*b* is formed on the upper end side of the mounting preventing transfer members 51*a*, 51*b*. The unit-side mounting preventing portion 43 can engage with the unit-side mounting allowing portion 53, and the auxiliary contact units 5*a*, 5*b* can be brought into intimate contact with and mounted on the unit mounting portion 3*g* of the reversible unit 3.

Further, when the mounting preventing transfer members 51*a*, 51*b* are not engaged inside the contactor-side mounting allowing portion 6*e*, the unit-side mounting allowing portion 53 is not formed at the unit mounting portion 3*g* of the reversible unit 3. However, when the auxiliary contact unit 4*a* (or 4*b*) is tilted, the hook pieces 40*b*, 40*c* are locked in the connection holes 3*i*, 3*j* (or 3*l*, 3*m*) of the reversible unit 3 and then the lower surface is rotated so as to contact with the unit mounting portion 3*g*, the upper end of the mounting preventing transfer members 51*a*, 51*b* is pushed by the unit mounting preventing portion 43 and the lower ends of the mounting preventing transfer members 51*a*, 51*b* are engaged inside the contactor-side mounting allowing portion 6*e*. For this reason, the mounting preventing transfer members 51*a*, 51*b* move down and the unit-side mounting allowing portion 53 similar to the contactor-side mounting allowing portion 6*e* of the electromagnetic contactors 2*a*, 2*b* is formed. Therefore, the snap piece 40*a* of the auxiliary contact units 4*a*, 4*b* can be inserted into the connection hole 3*h* of the unit mounting portion 3*g* of the reversible unit 3, and the lower surface of the auxiliary contact units 4*a*, 4*b* can be in intimate contact with and mounted on the unit mounting portion 3*g* of the reversible unit 3.

However, in the electromagnetic contactors 2*a*, 2*b* of the B type on which the auxiliary contact units 5*a*, 5*b* cannot be mounted, the contactor-side mounting allowing portion 6*e* is not formed at the position opposite the unit-side mounting preventing portion 43 of the auxiliary contact units 5*a*, 5*b* of the arc-suppressing cover 6*c* and the flat contactor-side mounting preventing portion 6*f* is formed, as shown in FIG. 7(*c*).

Therefore, when the reversible unit 3 is mounted on the electromagnetic contactors 2*a*, 2*b* as described hereinabove, since the contactor-side mounting allowing portion 6*e* is not present, as shown in FIG. 8(*c*), the mounting preventing transfer members 51*a*, 51*b* cannot protrude downward from the contactor mounting portion 3*b* of the reversible unit 3. Therefore, the upper surface of the mounting preventing transfer members 51*a*, 51*b* is flush with the front surface of the unit mounting portion 3*g* of the reversible unit 3 and the unit-side mounting preventing portion 54 is formed. This unit-side mounting preventing portion 54 is a flat surface similar to the contactor-side mounting preventing portion 6*f* of the electromagnetic contactors 2*a*, 2*b* where the contactor-side mounting allowing portion 6*e* is not formed.

Therefore, when the auxiliary contact units 4*a*, 4*b*, which are mountable units that can be mounted on the electromagnetic contactors 2*a*, 2*b*, are mounted on the unit mounting portion 3*g* of the reversible unit 3, the unit-side mounting preventing portion 43 is not formed at these auxiliary contact units 4*a*, 4*b*, as shown in FIG. 7(*b*) and the flat surface 44 is formed instead thereof. Therefore, although the upper surface of the mounting preventing transfer members 51*a*, 51*b* of the reversible unit 3 is flush with the front surface of the unit mounting portion 3*g*, mounting can be normally performed.

However, when the auxiliary contact units 5*a*, 5*b*, which are non-mountable units that cannot be mounted on the electromagnetic contactors 2*a*, 2*b*, are mounted on the unit mounting portion 3*g* of the reversible unit 3, the unit-side mounting preventing portion 43 is formed, as shown in FIGS. 8, 11, and 12, at the lower surface of these auxiliary contact units 5*a*, 5*b*. Therefore, where the auxiliary contact unit 5*a* (or 5*b*) is rotated counterclockwise, while being tilted, as shown in FIG. 12(*a*), so that the rear surface of the auxiliary contact unit 5*a* (or 5*b*) is mated with the unit mounting portion 3*g* of the reversible unit 3 in a state in which the hook pieces 40*c*, 40*d* are engaged with the connection holes 3*i*, 3*j* (or 3*l*, 3*m*) formed in the unit mounting portion 3*g* of the reversible unit 3, the distal end of the unit-side mounting preventing portion 43 abuts on the distal end of the mounting preventing transfer member 51*a* (or 51*b*) as shown in FIG. 12(*b*). Counterclockwise rotation of the auxiliary contact unit 5*a* (or 5*b*) is thereby prevented. As a result, the auxiliary contact unit 5*a* (or 5*b*) remains in the tilted state, the snap piece 40*a* cannot be locked to the connection hole 3*h* (or 3*k*) formed in the unit mounting portion 3*g* of the reversible unit 3, and the operator can clearly grasp the erroneous mounting state.

In this case, since the unit-side mounting preventing portion 43 is provided at a position close to the hook pieces 40*b*, 40*c*, even when the height of the engagement protrusion 43 is small, the auxiliary contact unit 5*a* (or 5*b*) can be prevented from mounting on the reversible unit 3 in a state in which the auxiliary contact unit 5*a* (or 5*b*) is significantly tilted.

Thus, according to the above-described embodiments, when the auxiliary contact units 5*a*, 5*b* that cannot be mounted on the electromagnetic contactors 2*a*, 2*b* are present, the unit-side mounting preventing portion 43 is formed on the mounting surface of the auxiliary contact units 5*a*, 5*b*. Furthermore, the contactor-side mounting allowing portion 6*e* that engages with the unit-side mounting preventing portion 43 is formed at the arc-suppressing cover 6*c* of the electromagnetic contactors 2*a*, 2*b* onto which the auxiliary contact units 5*a*, 5*b* can be mounted. Meanwhile, in the electromagnetic contactors 2*a*, 2*b* onto which the auxiliary contact units 5*a*, 5*b* cannot be mounted, the flat contactor-side mounting preventing portion 6*f* is formed at the arc-suppressing cover 6*c* at the position corresponding to the unit-side mounting allowing portion 6*e*. With such a configuration, erroneous mounting of the auxiliary contact units 5*a*, 5*b* can be reliably prevented.

Further, when the reversible unit 3 is mounted on the electromagnetic contactors 2*a*, 2*b*, the mounting preventing transfer members 51*a*, 51*b* are slidably provided at positions opposite the contactor-side mounting allowing portion 6*e* or contactor-side mounting preventing portion 6*f* of the reversible unit 3. Therefore, when the lower ends of the mounting preventing transfer members 51*a*, 51*b* are engaged with the contactor-side mounting allowing portion 6*e*, the unit-side mounting allowing portion 53 corresponding to the contactor-side mounting allowing portion 6*e* is formed at the unit mounting portion 3*g* of the reversible unit 3. By contrast, where the lower ends of the mounting preventing transfer members 51*a*, 51*b* abut on the contactor-side mounting preventing portion 6*f*, the upper ends of the mounting preventing transfer members 51*a*, 51*b* are flush with the flat surface of the unit mounting portion 3*g* of the reversible unit 3 and the flat unit-side mounting preventing portion 54 corresponding to the contactor-side mounting preventing portion 6*f* is formed.

As a result, the contactor-side mounting allowing portion 6*e* or the contactor-side mounting preventing portion 6*f* of the electromagnetic contactors 2*a*, 2*b* can be accurately transferred to the unit mounting portion 3*g* of the reversible unit 3 by the mounting preventing transfer members 51*a*, 51*b*, and even when the contactor-side mounting allowing portion 6*e* or the contactor-side mounting preventing portion 6*f* of the electromagnetic contactors 2*a*, 2*b* is covered by the reversible unit 3, erroneous mounting of the non-mountable auxiliary contact units 5*a*, 5*b* can be reliably prevented. Furthermore, a simple feature of providing the mounting preventing transfer members 51*a*, 51*b* slidably on the reversible unit 3 can be used for preventing such erroneous mounting.

Further, the unit-side mounting preventing portion 43 formed at the auxiliary contact units 5*a*, 5*b* that are non-mountable units which cannot be mounted on the electromagnetic contactors 2*a*, 2*b* is formed at the tilted surface 43*a* such that the side thereof opposite the side facing the hook pieces 40*b* and 40*c* is tapered gradually toward the distal end. The resultant merit is that when the auxiliary contact units 5*a*, 5*b* are mounted on the electromagnetic contactors 2*a*, 2*b* or the reversible unit 3 onto which the auxiliary contact units can be mounted, the engagement can be easily and reliably performed with the contactor-side mounting allowing portion 6*e* or the unit-side mounting allowing portion 53 that is formed by the mounting preventing transfer members 51*a*, 51*b* corresponding thereto.

Furthermore, the locking members acting when the auxiliary contact units 5*a*, 5*b* are mounted on the electromagnetic contactors 2*a*, 2*b* or the reversible unit 3 is constituted by the snap piece 40*a* and hook pieces 40*b*, 40*c*. Therefore, when the auxiliary contact units 5*a*, 5*b* are mounted on the electromagnetic contactors 2*a*, 2*b* or the reversible unit 3, the hook pieces 40*b*, 40*c* are always locked to the connection holes 13, 14 of the electromagnetic contactors 2*a*, 2*b* or the connection holes 3*i*, 3*j* or 3*l*, 3*m* of the reversible unit 3 and then the snap piece 40*a* is locked to the connection hole 12 of the electromagnetic contactors 2*a*, 2*b* or the connection hole 3*h* or 3*k* of the reversible unit 3. As a result, the auxiliary contact units 5*a*, 5*b* should be mounted obliquely, as shown in FIGS. 12(*a*)-12(*c*), and erroneous mounting can be reliably grasped.

In the abovementioned embodiments, the case is explained in which the reversible unit 3 is used as the mounting unit for an electromagnetic contactor, but such a configuration is not limiting. When a non-mountable unit that cannot be mounted on the electromagnetic contactor is present and the contactor-side mounting preventing portion is formed at the electromagnetic contactor, the mounting preventing transfer member 51*a* or 51*b* may be formed at the mounting unit for an electromagnetic contactor that is mounted between the electromagnetic contactor and the non-mountable unit.

Further, in the abovementioned embodiments, the case is explained in which the rod-shaped portion 51*a* of the mounting preventing transfer member 51 is formed in a quadrangular columnar shape, but such a configuration is not limited and the rod-shaped portion can be formed in another angular columnar shape or cylindrical shape or may have any cross-sectional shape. The case is also explained in which the rod-shaped portion 51*a* is formed linearly as a quadrangular column, but such a configuration is not limited and the rod-shaped portion can have a curved shape such as a crank shape.

Further, in the abovementioned embodiments, the case is explained in which the flat contactor-side mounting preventing portion 6*f* replacing the contactor-side mounting allowing portion 6*e*, which is the engagement depression, is formed at the electromagnetic contactors 2*a*, 2*b* where a non-mountable unit that cannot be mounted is present, but the contactor-side mounting preventing portion 6*f* is not necessarily a flat surface and may be a slightly receding depression or a protrusion that protrudes in the opposite direction.

Further, in the abovementioned embodiments, the case is explained in which the contactor-side mounting preventing portion 6*f* formed at the electromagnetic contactors 2*a*, 2*b* side is formed on a flat surface, and the unit-side mounting preventing portion 43 at the auxiliary contact units 5*a*, 5*b* side is formed by an engaging protrusion. However, this configuration is not limiting. Thus, the contactor-side mounting preventing portion 6*f* at the electromagnetic contactors 2*a*, 2*b* side where the non-mountable unit that cannot be mounted is present may be an engaging protrusion, and the unit-side mounting preventing portion 43 at the auxiliary contact units 5*a*, 5*b* side may be formed on the flat surface.

Further, in the abovementioned embodiments, the case is explained in which the unit-side mounting preventing portion 43 is provided close to, on the inner side of, and at a substantially central position between the hook pieces 40*b*, 40*b*, but such a configuration is not limited to such configuration, and the unit-side mounting preventing portion 43 can be formed at any position, provided that this position is within a surface that is in contact with the reversible unit 3. The positions of the contactor-side mounting preventing portion 6*f* of the electromagnetic contactors 2*a*, 2*b* and the mounting preventing transfer members 51*a*, 51*b* of the reversible unit 3 may be changed according to the position of the unit-side mounting preventing portion 43.

INDUSTRIAL APPLICABILITY

The present invention can provide a mounting unit for an electromagnetic contactor that can reliably prevent mounting of a non-mountable unit that cannot be mounted on the electromagnetic contactor in a state in which the mounting unit for an electromagnetic contactor is mounted on the electromagnetic contactor and a connection structure of the electromagnetic contactor using the mounting unit.

EXPLANATION OF REFERENCE NUMERALS

2*a*, 2*b* . . . electromagnetic contactors; 3 . . . reversible unit; 3*a* . . . unit main body; 3*b* . . . contactor mounting portion; 3*c* to 3*f* . . . snap pieces; 3*g* . . . unit mounting portion; 3*h* to 3*m* . . . connection holes; 4*a*, 4*b*, 5*a*, 5*b* . . . auxiliary contact units; 6 . . . main body case; 6*a* . . . lower case; 6*b* . . . upper case; 6*c* . . . arc-suppressing cover; 6*c*1 . . . level support portion; 6*c*2 . . . display window; 6*e* . . . contactor-side mounting allowing portion; 6*f* . . . contactor-side mounting preventing portion; 7 . . . contact portion; 7*a* . . . movable contact support; 7*a*1 . . . operation display piece; 7*b* . . . return spring; 7*c* . . . movable contact; 8 . . . electromagnet; 8*a* . . . coil; 8*b* . . . coil frame; 8*c* . . . fixed core; 8*d* . . . movable core; 9 . . . drive lever; 10 . . . terminal portion; 11 . . . coil terminal portion; 12 to 15 . . . connection holes; 31 . . . interlock mechanism; 32*a*, 32*b* . . . sliding members; 33 . . . sliding restricting member; 34 . . . rotation restricting member; 36*a*, 36*b* . . . operation display piece; 39 . . . main body case; 39*a*, 39*b* . . . unit windows; 40*a* . . . snap piece; 40*b*, 40*c* . . . hook pieces; 42*a* . . . display piece engagement portion; 43 . . . engagement protrusion; 50 . . . through hole; 51 . . . mounting preventing transfer member; 51*a* . . . rod-shaped portion; 51*b* . . . fall-out preventing portion; 52 . . . guiding groove; 53 . . . unit-side mounting allowing portion; 54 . . . unit-side mounting preventing portion

What is claimed is:

1. A combination comprising:

an electromagnetic contactor having a unit attaching portion, and a contactor-side mounting preventing portion formed on the unit attaching portion, said contactor-side mounting preventing portion preventing mounting of a non-mountable unit, and an electromagnetic contactor unit mountable on the electromagnetic contactor, comprising:

a unit main body, a unit mounting portion formed on the unit main body, and a mounting preventing transfer member formed in the unit main body, said mounting preventing transfer member movably disposed in the unit main body and engaging with the contactor-side mounting preventing portion when mounted on the electromagnetic contactor so that the mounting preventing portion forms a unit-side mounting preventing portion for preventing mounting of the non-mountable unit on the unit mounting portion.

2. A combination according to claim 1, wherein the mounting preventing transfer member comprises:

a rod-shaped portion slidably disposed in a through hole formed in the unit main body to face the contactor-side mounting preventing portion when the electromagnetic contactor unit is mounted on the electromagnetic contactor; and a fall-out preventing portion protruding laterally from an intermediate portion of the rod-shaped portion.

3. A combination according to claim 2, wherein a connection hole is formed in at least one side portion of the unit attaching portion of the electromagnetic contactor, the contactor-side mounting preventing portion is formed close to the connection hole, a hook piece locking with the connection hole is formed to protrude in a portion for mounting on the electromagnetic contactor, the through hole is formed close to the hook piece, and a linking hole is formed outside of the through hole in the unit mounting portion.

4. A combination according to claim 1, wherein a case body is mounted over a plurality of unit attaching portions of electromagnetic contactors disposed parallel to one another and includes therein an interlock mechanism prohibiting simultaneous loading of the electromagnetic contactors.

5. A combination comprising:

an electromagnetic contactor having a unit attaching portion on one side thereof;

a mountable unit mountable on the unit attaching portion of the electromagnetic contactor; and a non-mountable unit not mountable on the electromagnetic contactor, wherein the unit attaching portion has a contactor-side mounting preventing portion for preventing erroneous mounting of the non-mountable unit; and the mountable unit includes a unit mounting portion for mounting the non-mountable unit, and a mounting preventing transfer member forming a unit-side mounting preventing portion for preventing a mounting of the non-mountable unit on the unit mounting portion when the mounting preventing transfer member engages the contactor-side mounting preventing portion.

6. An electromagnetic contactor unit mountable on an electromagnetic contactor, comprising:

a unit main body having a through hole therein, a unit mounting portion formed on the unit main body for mounting a mountable unit or a non-mountable unit, and a movable member slidably disposed in the through hole, said movable member projecting outwardly from the unit main body to form a dent in the through hole at the unit mounting portion to allow the mountable unit to be mounted on the unit mounting portion or closing the through hole without projecting outwardly to prevent mounting of the non-mountable unit on the unit mounting portion.

7. An electromagnetic contactor unit according to claim 6, wherein said unit main body further includes a guiding groove communicating with the through hole, and the movable member includes a protrusion protruding outwardly from a middle portion of the movable member, said protrusion engaging the guide groove.

8. An electromagnetic contactor unit according to claim 7, wherein the movable member is a rod-shaped portion, and the protrusion is a fall-out preventing portion.

* * * * *

UNITED STATES PATENT AND TRADEMARK OFFICE

CERTIFICATE OF CORRECTION

PATENT NO. : 8,514,041 B2
APPLICATION NO. : 13/500004
DATED : August 20, 2013
INVENTOR(S) : Yasuhiro Naka et al.

It is certified that error appears in the above-identified patent and that said Letters Patent is hereby corrected as shown below:

In the Specification

Please change column 1, line 35 to 36, "No. 563-187523." to --No. S63-187523.--.

Signed and Sealed this
First Day of April, 2014

Michelle K. Lee

Michelle K. Lee
*Deputy Director of the United States Patent and Trademark Office*